US006111187A

United States Patent [19]

Goyette

[11] Patent Number: 6,111,187

[45] Date of Patent: Aug. 29, 2000

[54] ISOLATED COMPENSATED FLUID DELIVERY SYSTEM

[75] Inventor: Aime B. Goyette, North Dartmouth, Mass.

[73] Assignee: The United States of America as represented by the Secretary of the Navy, Washington, D.C.

[21] Appl. No.: 09/054,317

[22] Filed: Mar. 31, 1998

[51] Int. Cl.[7] ..... F42B 19/00; B65D 35/28

[52] U.S. Cl. ..... 114/20.1; 222/95; 222/85; 222/386.5; 158/50.1

[58] Field of Search ..... 114/20.2, 317, 114/20.1; 222/95, 92

[56] References Cited

U.S. PATENT DOCUMENTS

| | | | |
|---|---|---|---|
| 1,207,333 | 12/1916 | Shonnard | 114/20.1 |
| 1,311,984 | 8/1919 | Maxim | 114/20.1 |
| 2,949,877 | 8/1960 | Newburn et al. | 114/20.1 |
| 2,974,619 | 3/1961 | Bombl et al. | 114/20.1 |
| 3,048,137 | 8/1962 | Calehuff | 114/20.1 |
| 3,067,810 | 12/1962 | Mozic | 158/50.1 |
| 3,134,353 | 5/1964 | Pedersen et al. | 114/20.1 |
| 3,158,994 | 12/1964 | Hodgson | 114/20.1 |
| 3,175,525 | 3/1965 | De Vries | 114/20.1 |
| 3,286,463 | 11/1966 | McGroarty | 60/39.48 |
| 3,339,803 | 9/1967 | Wayne et al. | 222/95 |
| 3,713,413 | 1/1973 | Nakamura | 114/20 |
| 3,798,919 | 3/1974 | Hershner, Sr. | 62/45 |
| 3,808,996 | 5/1974 | Gezari | 114/0.5 |
| 3,883,046 | 5/1975 | Thompson et al. | 222/386 |
| 4,007,700 | 2/1977 | Haynes et al. | 114/74 |
| 4,013,195 | 3/1977 | Ferris | 222/95 |
| 4,264,018 | 4/1981 | Warren | 222/95 |
| 4,412,419 | 11/1983 | Thomas et al. | 60/634 |

*Primary Examiner*—Charles T. Jordan
*Assistant Examiner*—Denise J. Buckley
*Attorney, Agent, or Firm*—Michael J. McGowan; Robert W. Gauthier; Prithvi C. Lall

[57] ABSTRACT

An isolated compensated fluid delivery system is used in an underwater vessel, such as a torpedo, to deliver a supply fluid such as fuel, while displacing the supply fluid with a compensating fluid to compensate for change in buoyancy of the underwater vessel. The buoyancy compensated fluid delivery system includes a container, such as a fuel tank, a flexible delivery chamber disposed within the container adjacent a flexible compensation chamber. An outlet is coupled to the flexible delivery chamber and extends outside the container to direct the supply fluid out of the flexible delivery chamber. An inlet is coupled to the flexible compensation chamber and extends outside the container to direct the compensating fluid into the flexible compensation chamber as the supply fluid is being delivered. The volume of compensating fluid is substantially equivalent to the volume of supply fluid such that the weight and displacement of the underwater vessel remains substantially constant. The flexible delivery chamber and fluid compensation chamber both isolate the supply fluid and compensating fluid respectively from the inside of the container or fuel tank to prevent corrosion.

11 Claims, 2 Drawing Sheets

ISOLATED COMPENSATED FLUID DELIVERY SYSTEM

The invention described herein may be manufactured and used by or for the Government of the United States of America for governmental purposes without the payment of any royalties thereon or therefore.

BACKGROUND OF THE INVENTION (1). Field of the Invention

The present invention relates to fluid delivery systems and in particular, to an isolated compensated fuel delivery system for use in an underwater vessel.

(2). Description of the Prior Art

Underwater vessels, such as torpedoes, typically burn a liquid fuel contained in a fuel tank on the vessel. The emptying of the fuel tank as the fuel burns causes a change in the buoyancy of the underwater vessel that adversely affects the operation and movement of the vessel. Furthermore, free liquid surfaces of the fuel in a partially empty fuel tank can affect the stability of the underwater vessel or torpedo.

Conventional fuel delivery systems have displaced the liquid fuel with sea water as the fuel is burned to compensate for the loss of weight and volume of the burned fuel. One problem with this system is the corrosion in the aluminum fuel tanks when exposed to sea water and OTTO fuel, a monopropellant or fuel commonly used in torpedoes which has its own oxidizer that does not need air to provide oxygen. To prevent the corrosion, the fuel tanks must be flushed immediately after use with fresh water. Flushing the fuel tanks is time consuming, tedious and often not feasible.

One type of system uses a single bladder to separate the sea water from the fuel remaining in the tank, such as the type provided by BOFORS of Sweden. One disadvantage of this system is that existing fuel tanks, such as those used in heavyweight and lightweight torpedoes, would require extensive modifications to install the single bladder.

SUMMARY OF THE INVENTION

One object of the present invention is to compensate for changes in buoyancy of an underwater vessel while supplying or delivering fuel or another type of fluid from the underwater vessel.

Another object of the present invention is to isolate the inside of a fuel tank or other type of container from the fuel or other type of fluid being delivered and from the compensating fluid being received to displace the fuel, thereby eliminating the need to flush the fuel tank.

A further object of the present invention is to provide a buoyancy compensated fuel delivery system that can be retrofitted into existing fuel tanks on underwater vessels, such as heavyweight or lightweight torpedoes.

A still further object of the present invention is to provide a fuel delivery system which eliminates for liquid surfaces.

The present invention features a compensated fluid delivery system that delivers a supply fluid, such as fuel, while displacing the supply fluid with a compensating fluid. The system comprises a container, such as a fuel tank, for containing the supply fluid and the compensating fluid. A flexible delivery chamber is disposed within the container for holding the supply fluid and delivering a volume of the supply fluid while isolating the supply fluid from the container. An outlet is coupled to the flexible delivery chamber and extends outside of the container to direct the supply fluid out of the flexible delivery chamber. A flexible compensation chamber is disposed within the container adjacent the flexible delivery chamber, to receive a volume of the compensating fluid substantially equivalent to the volume of the supply fluid being delivered while isolating the compensating fluid from the container. An inlet is coupled to the flexible compensation chamber and extends outside of the container to direct the compensating fluid into the flexible compensation chamber.

In one embodiment, the flexible delivery chamber includes a first or fuel delivery bladder disposed within the container. The flexible compensation chamber also includes a second or fluid compensation bladder disposed within the container adjacent the first bladder.

According to another embodiment, the flexible delivery chamber and flexible compensation chamber include a bladder disposed within the container. The bladder includes a flexible wall extending across an interior region of the bladder. The flexible delivery chamber is formed on one side of the flexible wall, and the flexible compensation chamber is formed on an opposite side of the wall.

BRIEF DESCRIPTION OF THE DRAWINGS

These and other features and advantages of the present invention will be better understood in view of the following description of the invention taken together with the drawings wherein corresponding reference characters indicate corresponding parts throughout the several views of the drawings and wherein.

DESCRIPTION OF THE PREFERRED EMBODIMENT

Figure 1A:
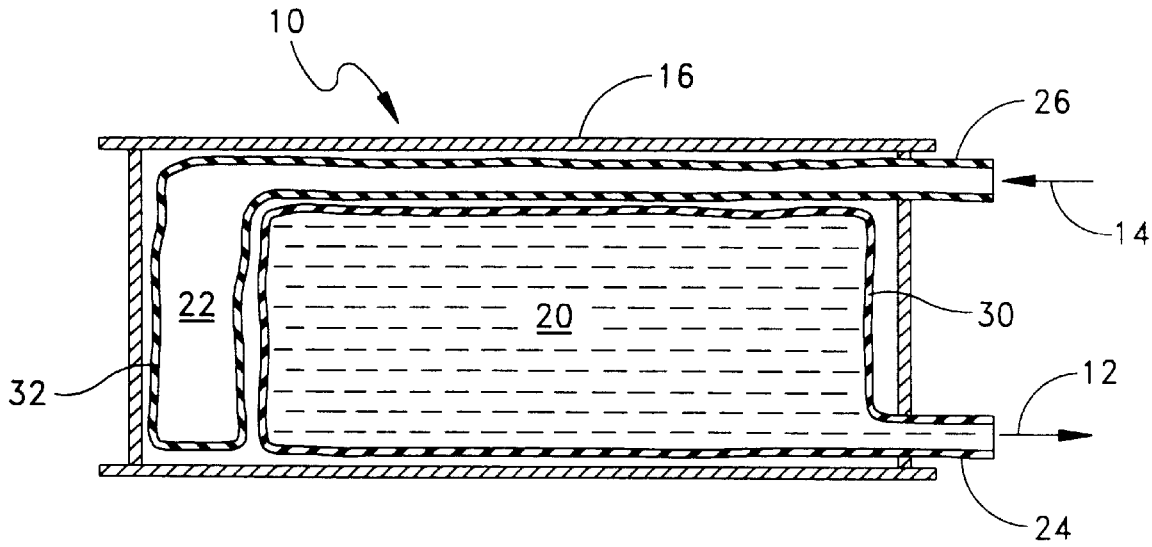
FIG. 1A is a schematic cross-sectional view of a compensated fluid delivery system, according to a first embodiment of the present invention, before the fluid has been supplied or delivered.
Figure 1B:
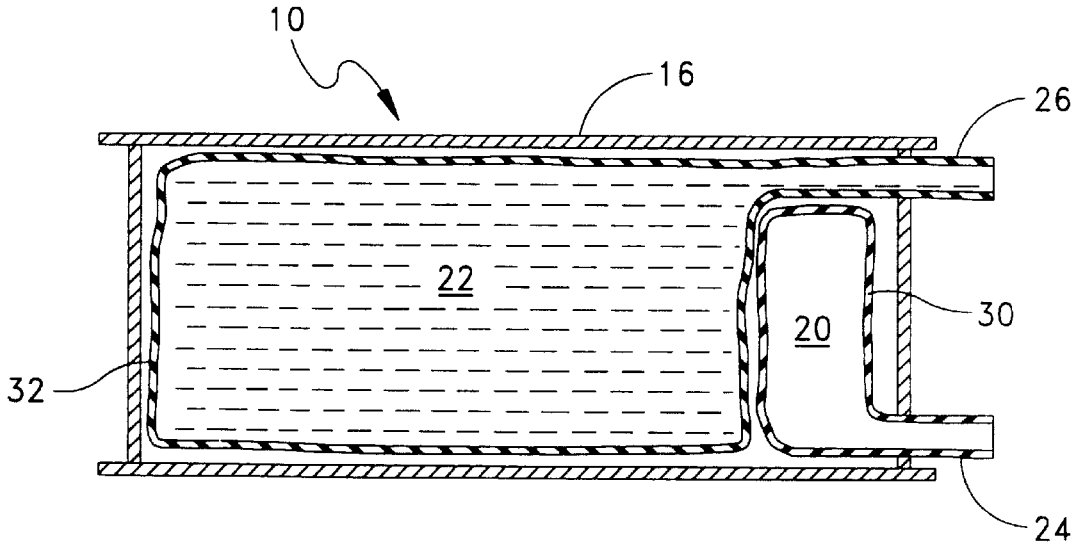
FIG. 1B is a schematic cross-sectional view of the compensated fluid delivery system, according to the first embodiment of the present invention, after the fluid has been delivered.

A compensated fluid delivery system 10, FIGS. 1A and 1B, according to the present invention, is used in an underwater vessel, such as a torpedo, to supply or deliver a supply fluid 12 while displacing the supply fluid 12 with a compensating fluid 14 to compensate for changes in buoyancy. According to the exemplary embodiment, the compensated fluid delivery system 10 is used to deliver fuel 12 in a torpedo, such as a heavyweight torpedo, or another type of underwater vessel while replacing the volume of fuel that has been delivered with a compensating fluid 14, such as water or sea water. The present invention also contemplates using air or carbon dioxide for the compensating fluid 14. Although this would not compensate for buoyancy, it would prevent free liquid surfaces, thereby stabilizing the vehicle. The present invention contemplates using the fluid delivery system 10 in other types of vessels with other types of fluids to compensate for the effects on the buoyancy and stability of the vessel.

The compensated fluid delivery system 10 includes a container 16, such as a fuel tank, made of a rigid material, such as metal, aluminum or plastic. The compensated fluid delivery system 10 further includes at least one flexible delivery chamber 20 disposed within the container 16 adjacent a flexible compensation chamber 22. The flexible delivery chamber 20 and flexible compensation chamber 22 may be provided as one or more flexible bladders, as will be described in greater detail below. The flexible delivery chamber 20 holds the supply fluid 12, such as the fuel, and isolates the supply fluid from the inside of the container 16. The flexible delivery chamber 20 supplies or delivers a volume of the supply fluid 12, for example, as the fuel burns, thereby depleting the supply fluid 12.

The flexible compensation chamber 22 receives a volume of compensating fluid 14, such as the sea water, in proportion to and as the supply fluid 12 is depleted. The volume of compensating fluid 14 being received is substantially equivalent to the volume of the supply fluid 12 being supplied or delivered. The flexible compensation chamber 22 isolates the compensating fluid 14 from the inside of the container 16. The isolation of the container 16 from both the supply fluid 12 (fuel) and compensating fluid 14 (sea water) prevents corrosion and avoids the need to flush the inside of the container 16. The elimination of the corrosion of the fuel tank or container 16 also extends the life of the fuel tank and results in a cost savings.

An outlet 24 is coupled to the flexible delivery chamber 20 and extends outside of the container 16 to direct the supply fluid 12 out of the flexible delivery chamber 20. An inlet 26 is coupled to the flexible compensation chamber 22 and extends outside of the container 16 to direct the compensating fluid 14 into the flexible compensation chamber 22. Inlet and outlet tubes or fittings 26,24 for flexible fuel cells are usually molded or machined fittings made from plastic or metal and are commercially available from a number of sources.

In one embodiment, the flexible delivery chamber 20 includes a first or fuel delivery bladder 30 disposed within the container 16. The flexible compensation chamber 22 includes a second or fluid compensation bladder 32 disposed within the container 16. In another embodiment described below, both the chambers 20, 22 are formed within a single bladder. The bladders are typically made of a resilient material, such as nitrile or neoprene coated nylon or other materials suitable for OTTO fuel or other types of compensating fluid and supply fluid.

In the first exemplary embodiment, the first or fuel delivery bladder 30, FIG. 1A, at the beginning of a run of a torpedo or other vessel, is filled with fuel and the second or fluid compensation bladder 32 is generally empty. The outlet 24 is coupled to a fuel pick up and the inlet 26 is coupled to a source of pressurized water or another compensating fluid. In heavyweight torpedoes, such as MK48/ADCAP torpedo, for example, the inlet 26 could be coupled to the coolant water pump or an additional pump to assist in replacing the used fuel. A pump may not be required if the displaced volume of the used fuel causes water to be drawn into bladder 32. The compensating fluid also facilitates supplying the fuel by helping to "push out" the fuel.

As the torpedo burns the fuel, the fuel supply in the fuel delivery bladder 30, FIG. 1B, is depleted. As the fuel supply is depleted, a substantially equivalent volume of the water or other compensating fluid is pumped into the fluid compensation bladder 32. Thus, as the fuel delivery bladder 30 empties, the fluid compensation bladder 32 is filled, and the weight and displacement remains substantially constant. Accordingly, the buoyancy and stability of the torpedo or underwater vessel is not adversely affected by an empty or partially empty fuel tank.

Figure 2A:
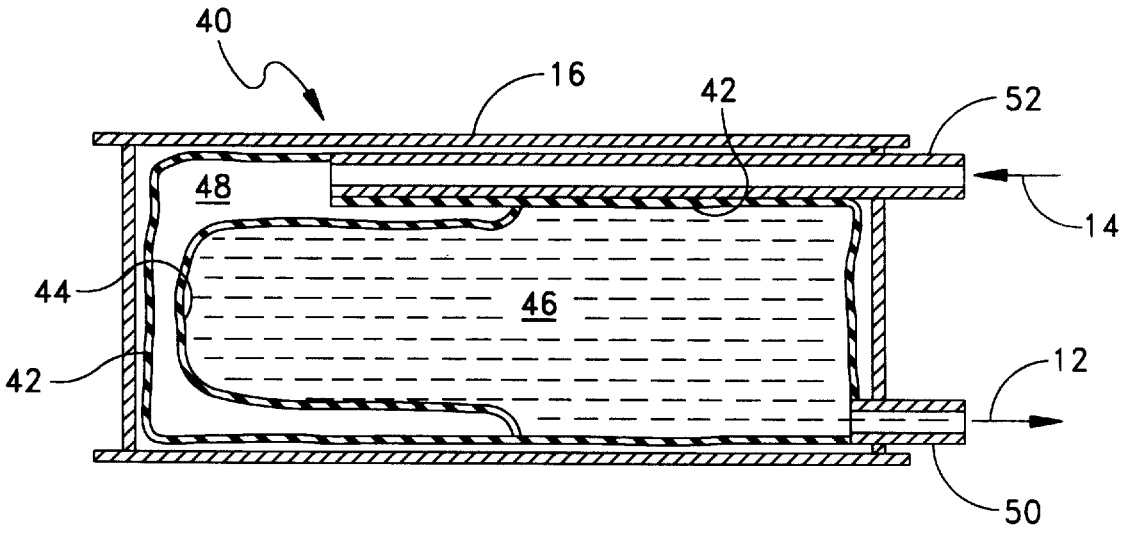
FIG. 2A is a schematic cross-sectional view of a compensated fluid delivery system, according to a second embodiment of the present invention, before the fluid has been delivered.
Figure 2B:
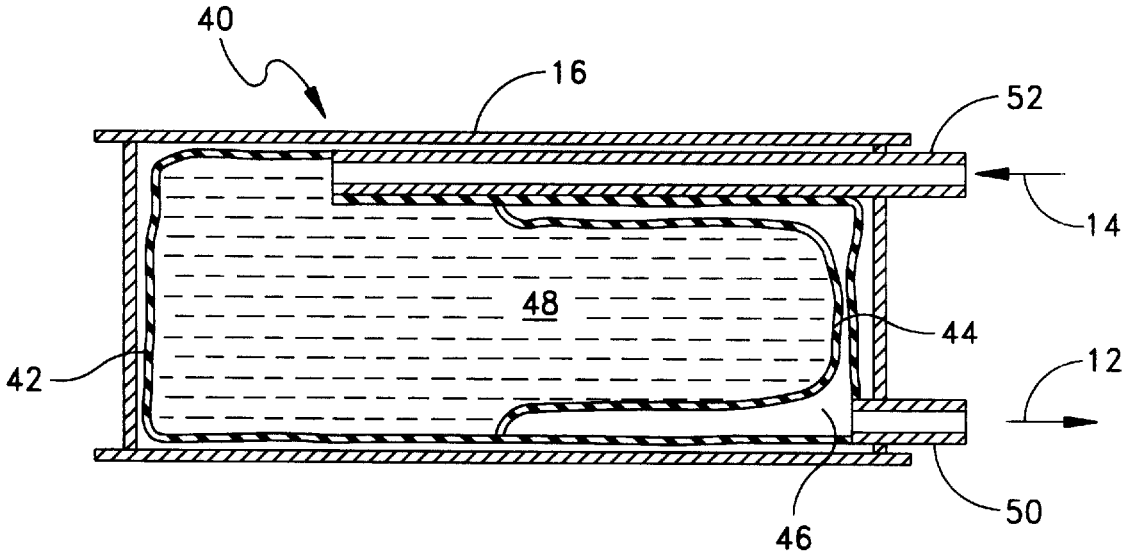
FIG. 2B is a schematic cross-sectional view of the compensated fluid delivery system, according to the second embodiment of the present invention, after the fluid has been delivered.

The second embodiment of the compensated fluid delivery system 40, FIGS. 2A and 2B, includes a single bladder 42 disposed within the container 16, such as the fuel tank. The bladder 42 includes a flexible wall 44 extending across an interior region of the bladder 42. The fluid delivery chamber or region 46 is formed on one side of the flexible wall 44 within the bladder 42 for holding the fuel and delivering a volume of the fuel. The fluid compensation chamber or region 48 is formed on an opposite side of the flexible wall 44 within the bladder 42, for receiving a volume of the compensating fluid substantially equivalent to the volume of fuel being delivered. An outlet 50 is coupled to the fuel delivery region 46 and extends outside of the container 16 to direct the fuel from the fuel delivery region 46. An inlet 52 is coupled to the fluid compensation region 48 to direct the compensating fluid into the fluid compensation region 48 as the fuel delivery region 46 is emptied. Outlet 50 and inlet 52 are shown in FIGS. 2A and 2B as fabricated of metal, but it will be understood that they may be molded from plastic in a manner similar to inlet and outlet tubes or fittings 26 and 24 of FIGS. 1A and 1B. The inlet 52 is coupled to a source of compensating fluid which could be at ambient pressure or supplied by the coolant water supply provided by the water pump. The compensating fluid is led to region 48 of the bladder. The outlet is coupled to region 46 and a fuel pump inlet. The fuel pump draws fuel out as it would in its current MK48/ADCAP system.

As discussed above, the fuel delivery region 46, FIG. 2A, at the beginning of a run, is full and the flexible wall 44 is expanded to maximize the volume of the fuel delivery region 46. As the fuel delivery region 46 is emptied, the flexible wall 44, FIG. 2B, moves and expands in an opposite direction to maximize a volume of the fluid compensation chamber 48, as the fluid compensation chamber 48 is filled.

The compensated fluid delivery system 40 having the single bladder 42 also isolates both the supply fluid or fuel and the compensating fluid or sea water from the inside of the container 16 or fuel tank. Corrosion of the inside of the fuel tank is thereby prevented and the need to flush the inside of the fuel tank is eliminated.

Both the embodiment having two bladders and the embodiment having a single bladder with a flexible wall can be retrofitted into existing fuel tanks used on heavyweight and lightweight torpedoes. After use, the bladders can be reused or disposed of by incineration or other methods.

Accordingly, the compensated fluid delivery system of the present invention delivers a supply fluid, such as fuel, while compensating for the lost supply fluid by receiving a substantially equivalent volume of compensating fluid, such as sea water, thereby compensating for changes in buoyancy in an underwater vessel or torpedo. The compensated fluid delivery system isolates the supply fluid or fuel and the compensating fluid from the inside of the container or fuel tank, preventing corrosion of the fuel tank. The buoyancy compensated fluid delivery system of the present invention can also be retrofitted with existing fuel tanks in vessels such as heavyweight and lightweight torpedoes.

Obviously, many modifications and variations of the present invention may become apparent in light of the above teachings. For example, the exact style and configurations of the bladders can be changed to suit manufacturing and assembly consideration as well as shape of the fuel tank and location of inlet and outlet ports. Additionally, in lightweight torpedoes and other vessels where buoyancy compensation is not required, the compensating fluid can be air or carbon dioxide. In lightweight torpedoes, carbon dioxide under pressure may be pumped into the flexible compensation chamber. The pressure against the delivery chamber would force the fuel out of the delivery chamber.

In light of the above, it is therefore understood that within the scope of the appended claims, the invention may be practiced otherwise than as specifically described.

What is claimed is:

1. A compensated fluid delivery system, for delivering fuel to an underwater vessel while displacing said fuel with sea water, said system comprising:

a fuel tank for containing said fuel and said sea water;

a flexible delivery chamber, disposed within said fuel tank, for holding said fuel and delivering a volume of said fuel, wherein said flexible delivery chamber isolates said fuel from said fuel tank;

an outlet, coupled to said flexible delivery chamber, for directing said fuel out of said flexible delivery chamber;

a flexible compensation chamber, disposed within said fuel tank and adjacent said flexible delivery chamber, for receiving a volume of said sea water substantially equivalent to said volume of said fuel being delivered, wherein said flexible compensation chamber isolates said sea water from said fuel tank;

a coolant pump for pumping said sea water; and an inlet, coupled to said flexible compensation chamber, for directing said sea water into said flexible compensation chamber.

2. The system of claim 1 wherein:

said flexible delivery chamber includes a first bladder disposed within said container; and said flexible compensation chamber includes a second bladder disposed within said container.

3. The system of claim 2 wherein said first and second bladders are made of material compatible with the sea water and with the fuel.

4. The system of claim 1 wherein said flexible delivery chamber and flexible compensation chamber include a bladder disposed within said fuel tank, said bladder includes a flexible wall extending across an interior region of said bladder, said flexible delivery chamber being formed on one side of said flexible wall and said flexible compensation chamber being formed on an opposite side of said wall.

5. The system of claim 4 wherein said bladder and said flexible wall are made of material compatible with the sea water and with the fuel.

6. A compensated fuel delivery system for use in an underwater vessel, said system comprising:

a fuel tank;

a fuel delivery bladder, disposed within said fuel tank, for holding fuel and for delivering a volume of said fuel;

an outlet, coupled to said fuel delivery bladder, for directing said fuel from said fuel delivery bladder;

a fluid compensation bladder, disposed within said fuel tank, for receiving a volume of compensating fluid substantially equivalent to said volume of fuel being delivered as said fuel is being delivered; and an inlet, coupled to said fluid compensation bladder, for directing said compensating fluid into said fluid compensation bladder.

7. The system of claim 6 wherein said fluid is sea water.

8. The system of claim 6 wherein said compensating fluid is carbon dioxide.

9. A compensated fuel delivery system for use in an underwater vessel, said system comprising:

a fuel tank;

a bladder disposed within said fuel tank, said bladder having a flexible wall extending across an interior region of said bladder;

a fuel delivery region, formed on one side of said flexible wall within said bladder, for holding fuel and for delivering a volume of said fuel;

an outlet, coupled to said fuel delivery region, for directing said fuel from said fuel delivery region;

a fluid compensation region, formed on an opposite side of said flexible wall within said bladder, for receiving a volume of compensating fluid substantially equivalent to said volume of fuel being delivered as said fuel is being delivered; and an inlet, coupled to said fluid compensation region, for directing said compensating fluid into said fluid compensation region.

10. The system of claim 9 wherein said compensating fluid is sea water.

11. The system of claim 9 wherein said compensating fluid is carbon dioxide.

* * * * *